US005873807A

United States Patent [19]

Lauderbaugh et al.

[11] Patent Number: 5,873,807

[45] Date of Patent: Feb. 23, 1999

[54] SCORING ASSEMBLY

[75] Inventors: David M. Lauderbaugh, Roswell; Park C. Jeans, III, Mableton; Larry L. Tallant, Cumming, all of Ga.

[73] Assignee: Corrugated Gear & Services, Inc., Alpharetta, Ga.

[21] Appl. No.: 902,269

[22] Filed: Jul. 29, 1997

Related U.S. Application Data

[63] Continuation of Ser. No. 407,194, Mar. 20, 1995.

[51] Int. Cl.[6] ..... B31B 1/25

[52] U.S. Cl. ..... 493/403; 83/887; 83/663

[58] Field of Search ..... 493/59–61, 396–398, 493/402–403, 355; 83/886, 887, 663

[56] References Cited

U.S. PATENT DOCUMENTS

| | | | |
|---|---|---|---|
| 2,048,684 | 7/1936 | Carr | 493/403 X |
| 2,139,890 | 12/1938 | Fitchett . | |
| 2,475,868 | 7/1949 | Anderson . | |
| 3,157,398 | 11/1964 | Zahradnik | 493/403 X |
| 3,314,339 | 4/1967 | Guffy et al. . | |
| 3,318,206 | 5/1967 | Kuehn et al. . | |
| 3,522,754 | 8/1970 | Sauer . | |
| 3,522,762 | 8/1970 | Sauer . | |
| 3,618,436 | 11/1971 | Brown . | |
| 3,677,122 | 7/1972 | Rautine . | |
| 3,917,255 | 11/1975 | Watrous . | |
| 3,931,963 | 1/1976 | Bewersdorf | 493/403 X |
| 4,003,276 | 1/1977 | Schmitt . | |
| 4,073,208 | 2/1978 | Kirkpatrick . | |
| 4,141,544 | 2/1979 | Birkenmayer . | |
| 4,289,055 | 9/1981 | Von Schriltz . | |
| 4,678,457 | 7/1987 | Slobodkin . | |
| 4,795,414 | 1/1989 | Blumle | 493/403 |
| 4,936,818 | 6/1990 | Holohan, Jr. . | |
| 4,982,639 | 1/1991 | Kirkpatrick . | |
| 5,133,235 | 7/1992 | DeVito | 493/370 X |
| 5,393,295 | 2/1995 | Knecht | 493/403 |
| 5,496,253 | 3/1996 | Snellman et al. | 493/403 X |

*Primary Examiner*—Joseph J. Hail, III
*Assistant Examiner*—Anthony Ojini
*Attorney, Agent, or Firm*—Jones & Askew, LLP

[57] ABSTRACT

The present invention is directed to a scoring head assembly and method for creating score lines on corrugated board. The scoring head assembly includes a scoring head and an anvil. The scoring head is fixed to a first rotatable shaft and the anvil is fixed to a second rotatable shaft that rotates in the opposite direction from the first shaft. The scoring head is annular shaped and has a central annular extension. The anvil is made of a deformable material capable of variable deformation relative to the amount of pressure applied thereto by the scoring head.

23 Claims, 2 Drawing Sheets

SCORING ASSEMBLY

This is a continuation of Application Ser. No. 08/407,194 filed on Mar. 20, 1995.

TECHNICAL FIELD

The present invention relates generally to the corrugated board industry, and relates more specifically to an improved scoring assembly for creating score lines on corrugated board.

BACKGROUND OF THE INVENTION

In the corrugated board industry, corrugated board is manufactured in sheets. The corrugated board sheets are cut into pieces or "blanks" which are slotted and fold lines or "score lines" are formed on a blank to shape the blank into a particular form that is ultimately reconfigured into a cardboard box or case.

At present, a scoring assembly consists of a scoring head and an anvil. The scoring head and anvil are rotatably mounted on separate, oppositely rotating shafts. The cardboard is fed through the space between the head and anvil. The scoring head is typically made of a rigid material, such as stainless steel. A typical scoring head is shaped cylindrically, and has a slight central annular extension extending radially outward by 1/32 inches. The anvil is typically cylindrical.

The present type of scoring assembly operates effectively when the score lines are oriented perpendicular to the corrugation. However, when the score lines are not perpendicular to the corrugation or, in particular, when they are parallel to the corrugation, the present scoring assemblies do not operate effectively. This occurs because when the scoring head contacts the corrugated flute, the head tends to ride on one side of the flute or the other. This creates a misaligned, poor quality score line which results in what is called a "rolled" score. When the board does not fold crisply and completely along the score line, it is a rolled score. The presence of rolled scores ultimately results in a misaligned product.

Scoring assemblies must also be adaptable to different thicknesses and weights of board. Some scoring assemblies are effective with lighter, thinner board. When these assemblies encounter thicker or heavier weight board, the scoring head simply applies more pressure. However, this often causes the head to bury itself within the board which results in ripping or tearing of the board rather than creation of an effective score line. None of the scoring assemblies at present have the capability of adapting to different weight and thicknesses of board to effectively create quality score line in all situations.

Thus, there is a need for an improved scoring assembly where the scoring assembly can effectively form a score line relative to the weight and thickness of the corrugated board. There is a further need for an improved scoring assembly that creates an effective score along a line parallel to the corrugation of a corrugated board.

There is still a further need for an improved scoring assembly that does not rip or tear the corrugated board as it forms the score line.

SUMMARY OF THE INVENTION

As will be seen, the present invention overcomes these and other disadvantages associated with prior art scoring assemblies. Stated generally, the present invention is directed to a scoring head assembly and method for creating score lines on corrugated board. The scoring head assembly includes a scoring head and an anvil. The scoring head is fixed to a first rotatable shaft and the anvil is fixed to a second rotatable shaft that rotates in the opposite direction from the first shaft. The scoring head is annular shaped. The anvil is made of a resiliently deformable material and capable of variable deformation.

More particularly, the scoring assembly includes a scoring head has a central annular extension that extends considerably further than prior art scoring heads. The scoring assembly also includes an anvil having a central annular section located between two side anvil sections. The central section of the anvil is raised above the two side anvil sections. When the scoring head encounters lighter weight, or thin board, the anvil deforms slightly under the pressure applied by the scoring head. However, when heavier weight board passes through the scoring assembly, the anvil's level of deformation is limited and the anvil becomes rigid with additional pressure from the head. Moreover, the added length of the annular extension of the head allows the head to apply additional pressure to the anvil without ripping or tearing the board so that the score lines in the board are effectively created.

Accordingly, it is an object of the present invention to provide an improved scoring assembly where the scoring assembly can effectively form a score line relative to the weight and thickness of the corrugated board.

It is a further object of the present invention to provide an improved scoring assembly that creates an effective score along a line parallel to the corrugation of a corrugated board.

It is still a further object of the present invention to provide an improved scoring assembly that does not rip or tear the corrugated board as it forms the score line.

These and other objects, features and advantages of the present invention will become apparent upon reading the following detailed description of the preferred embodiment of the invention, when taken in conjunction with the drawings and appended claims.

BRIEF DESCRIPTION OF THE DRAWINGS

The invention will now be described with reference to the accompanying drawings, which illustrate a preferred embodiment of the improved scoring assembly, falling within the scope of the appended claims, and in which:

DETAILED DESCRIPTION OF THE INVENTION

Figure 1:
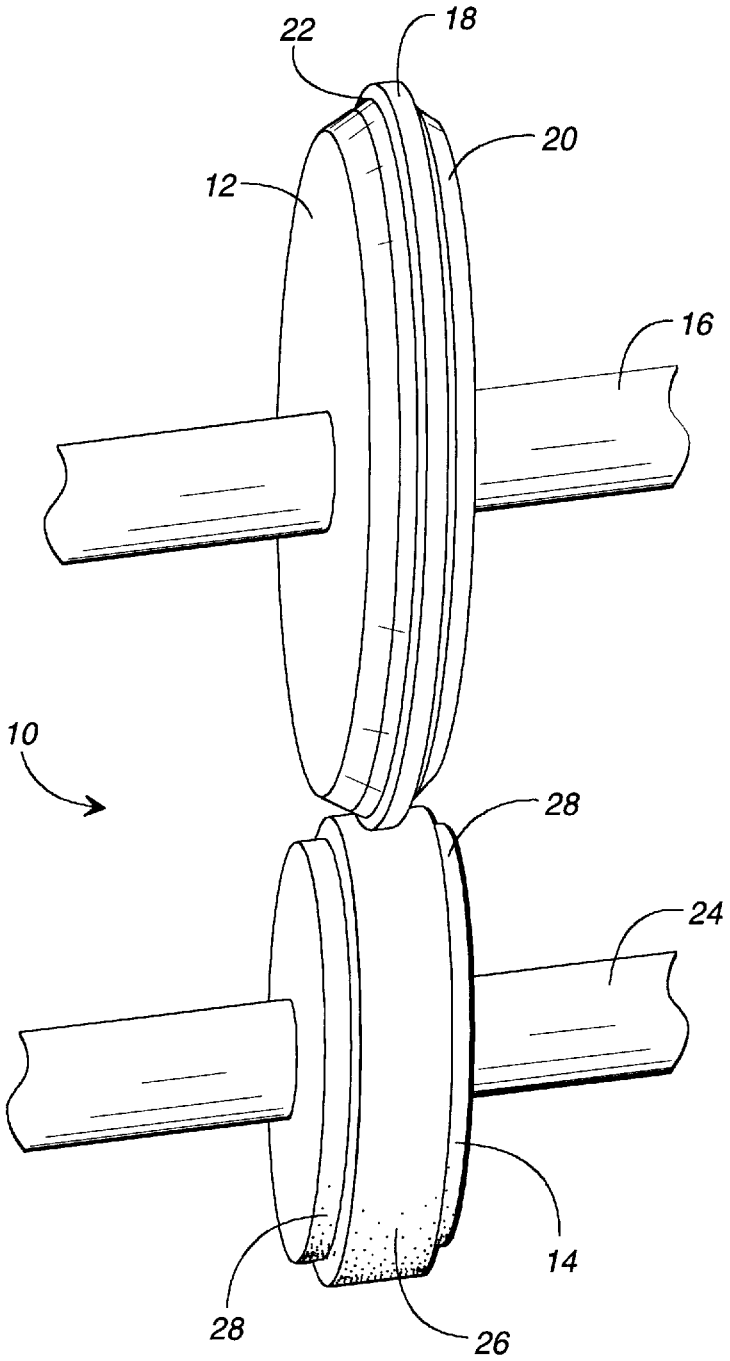
FIG. 1 is a perspective view of a scoring assembly of a preferred embodiment of the present invention.
Figure 2:
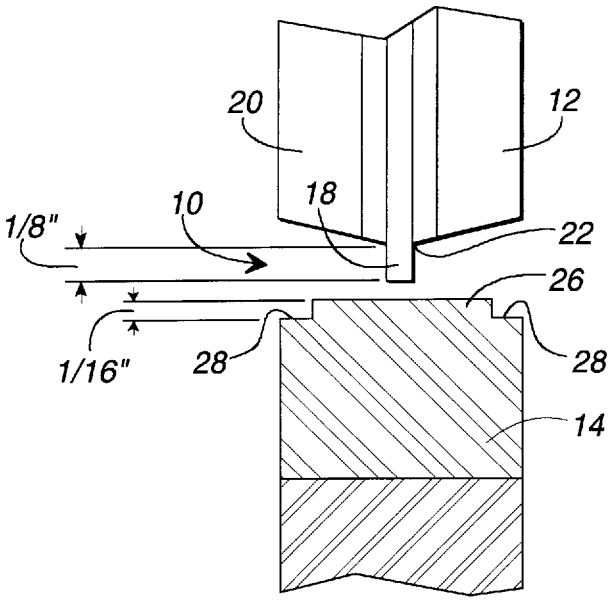
FIG. 2 is a cross sectional view of the preferred embodiment of FIG. 1.

Referring now in more detail to the drawings, in which like numerals indicate like parts throughout the several views, the improved scoring assembly 10 is shown in FIG. 1. The scoring assembly 10 includes a scoring head 12 and an anvil 14. The scoring head 12 is fixedly mounted on a first rotatable shaft 16. The scoring head 12 is annularly shaped and has a central annular extension 18 located between two side sections 20. The central annular extension 18 protrudes radially outward, as best shown in FIG. 2. It is preferable that the central annular extension 18 protrude 1/8 inches radially outward from the side sections 20. There is a tapered area 22 where the central annular extension 18 joins the side section 20.

Figure 3:
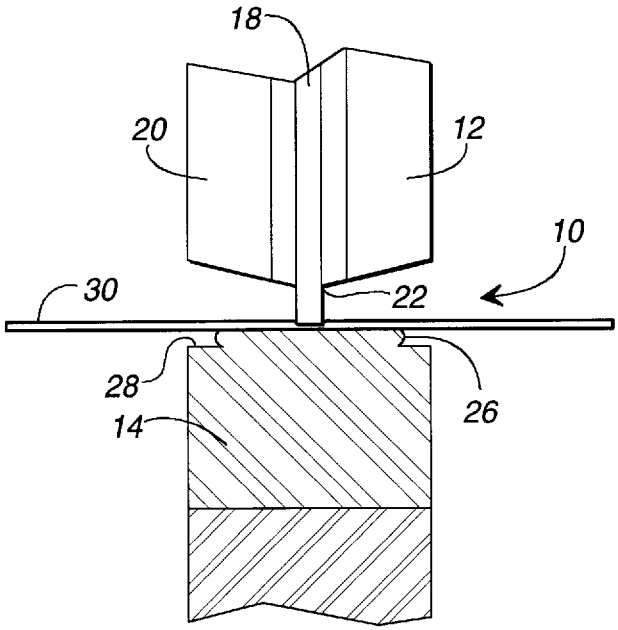
FIG. 3 is a cross-sectional view of the preferred embodiment of FIG. 1 in use.

The anvil 14 is fixedly mounted to a second rotatable shaft 24. The anvil 14 is annularly shaped and has a central section 26 located between two side anvil sections 28. The profile of the anvil, as shown in FIGS. 2 and 3, is stepped. The central section 26 is raised slightly radially outward from the two anvil side sections 28. It is preferred that the central section 26 of the anvil 14 be raised 1/16 inches radially outward from the side anvil sections 28.

The scoring head 12 is preferably made of a rigid material such as stainless steel. Conversely, the anvil 14 is preferably made of a resiliently deformable material, such as a thermoplastic resin. It is preferred that the anvil be made of urethane. Moreover, the anvil should have a hardness of between 30–100 durometer. It is preferred that the anvil have a hardness of between 60–90 durometer.

In operation, a sheet of corrugated board 30 is fed through the scoring head assembly 10 between the scoring head 12 and the anvil 14. The first and second shafts, 16 and 24, on which the scoring head 12 and anvil 14 are respectively mounted, rotate in opposite directions to help feed the corrugated board 30 through the scoring head assembly 10. As the board 30 passes between the scoring head 12 and anvil 14, the central annular extension 18 of the scoring head 12 impresses upon the anvil 14 to create a score line (not shown). The length of the central annular extension 18 allows the scoring head 12 to apply sufficient pressure to the board 30 and anvil 14 to create an effective score line without ripping or tearing the head. The tapered areas 22 between the central annular extension 18 and the side scoring head section 20 further reduces the possibility that the board will tear as the score line is being created. As the central annular extension 18 of the scoring head 12 presses upon the board 30, the central anvil section 26 deforms slightly with the pressure. The central anvil section 26 can deform linearly outwardly to the level it is raised relative to the side anvil sections 28, as shown in FIG. 3, and as a result of the material selected to manufacture the anvil 14.

If the pressure from the scoring head 12 increases to necessitate formation of score lines of heavier or thicker board, the central anvil section 26 ceases to deform past the extended portion of the central anvil section because there is nowhere for the material in the central anvil section to go. Thus, the central anvil section 26 becomes significantly more rigid and is able to effectively create a score line relative to the thickness and hardness of the board.

The length of the central annular extension 18 of the scoring head 12 further aids in eliminating rolled scores by enabling the scoring head to apply additional pressure on the board 30 and anvil 14 so that the head does not ride on either side of a corrugation flute but moves across the board in the predetermined direction.

It should be understood that numerous modifications or alternations may be made to the device without departing from the spirit and scope of the invention as set forth in the appended claims. For example, the anvil 14 may be made out of other resilienty deformable materials capable of the variable deformation described above. In addition, the profile of the anvil may be something other than stepped so long as the assembly achieves the variable deformation described above.

What is claimed is:

1. A scoring assembly for scoring paperboard of varying thickness comprising:

a scoring head fixed to a first rotating shaft, the scoring head comprising, an annular body member comprising a rigid material that extends radially outward with respect to the first rotating shaft, and a raised annular section extending radially outward from the body member of the scoring head, the raised annular section comprising a rigid material; and an anvil fixed to a second rotating shaft, the anvil comprising, an annular base formed of a resiliently deformable material that extends radially outward with respect to the second rotating shaft and when uncompressed defines a shoulder that includes a substantially axially facing side and a substantially radially outward facing side that is a first radial distance from the second rotating shaft, and an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance.

2. The scoring assembly of claim 1, wherein the annular section of the scoring head extends beyond the body member of the scoring head a greater distance than the annular section of the anvil extends beyond the base of the anvil when the annular section of the anvil is uncompressed.

3. The scoring assembly of claim 1, wherein:

the resiliently deformable material of the annular section of the anvil when uncompressed defines an axially facing side that is adjacent the shoulder of the anvil.

4. The scoring assembly of claim 1, wherein:

the resiliently deformable material of the annular section of the anvil when uncompressed defines an axially facing side that is adjacent the radially outward facing side of the shoulder of the anvil.

5. The scoring assembly of claim 1, wherein:

the shoulder of the anvil is a first shoulder;

the resiliently deformable material of the annular section of the anvil when uncompressed defines a first substantially axially facing side that is adjacent the first shoulder;

the resiliently deformable material of the base of the anvil defines a second shoulder that includes a substantially axially facing side and a substantially radially outward facing side that is a third radial distance from the second rotating shaft, the third distance being less than the second distance; and the resiliently deformable material of the annular section of the anvil when uncompressed defines a second substantially axially facing side that is adjacent and axially inset with respect to the second shoulder of the anvil.

6. The scoring assembly of claim 5, wherein:

the annular section of the anvil is located approximately in the center of the base of the anvil.

7. A method for scoring corrugated paperboard of varying thickness, comprising the steps of:

passing paperboard of varying thickness adjacent a scoring head fixed to a first rotating shaft, the scoring head comprising an annular body member comprising a rigid material that extends radially outward with respect to the first rotating shaft, the scoring head further comprising a raised annular section extending radially outward from the body member of the scoring head, the raised annular section comprising a rigid material;

positioning on the opposite side of the corrugated paperboard from the scoring head an anvil fixed to a second rotating shaft, the anvil comprising an annular base formed of a resiliently deformable material that extends radially outward with respect to the second rotating shaft and when uncompressed defines a shoulder that includes a substantially axially facing side and a substantially radially outward facing side that is a first radial distance from the second rotating shaft, the anvil further comprising an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance; and applying pressure to bias the anvil and the scoring head toward each other.

8. The method of claim 7, wherein:

the raised annular section of the scoring head extends beyond the body member of the scoring head a greater distance than the annular section of the anvil extends beyond the base of the anvil when the annular section of the anvil is uncompressed.

9. The method of claim 7, wherein:

the resiliently deformable material of the annular section of the anvil when uncompressed defines an axially facing side that is adjacent the shoulder of the anvil.

10. The method of claim 7, wherein:

the resiliently deformable material of the annular section of the anvil when uncompressed defines an axially facing side that is adjacent the radially outward facing side of the shoulder.

11. The method of claim 7, wherein:

the shoulder of the anvil is a first shoulder;

the resiliently deformable material of the annular section of the anvil when uncompressed defines a first substantially axially facing side that is adjacent the first shoulder;

the resiliently deformable material of the base of the anvil defines a second shoulder that includes a substantially axially facing side and a substantially radially outward facing side that is a third radial distance from the second rotating shaft, the third distance being less than the second distance; and the resiliently deformable material of the annular section of the anvil when uncompressed defines a second substantially axially facing side that is adjacent and axially inset with respect to the second shoulder of the anvil.

12. The method of claim 11, wherein the annular section of the anvil is located approximately in the center of the base of the anvil.

13. An anvil for a scoring assembly for scoring corrugated paperboard of varying thickness comprising:

an annular base formed of a resiliently deformable material that extends radially outward with respect to the second rotating shaft and when uncompressed defines a shoulder that includes a substantially axially facing side and a substantially radially outward facing side that is a first radial distance from the second rotating shaft, and an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance.

14. The anvil of claim 13, wherein:

the resiliently deformable material of the annular section of the anvil when uncompressed defines an axially facing side that is adjacent the shoulder of the anvil.

15. The anvil of claim 13, wherein:

the resiliently deformable material of the annular section of the anvil when uncompressed defines an axially facing side that is adjacent the radially outward facing side of the shoulder of the anvil.

16. The anvil of claim 13, wherein:

the shoulder of the anvil is a first shoulder;

the resiliently deformable material of the annular section of the anvil when uncompressed defines a first substantially axially facing side that is adjacent the first shoulder;

the resiliently deformable material of the base of the anvil defines a second shoulder that includes a substantially axially facing side and a substantially radially outward facing side that is a third radial distance from the second rotating shaft, the third distance being less than the second distance; and the resiliently deformable material of the annular section of the anvil when uncompressed defines a second substantially axially facing side that is adjacent and axially inset with respect to the second shoulder of the anvil.

17. The anvil of claim 16, wherein:

the annular section of the anvil is located approximately in the center of the base of the anvil.

18. A scoring assembly for scoring corrugated paperboard of varying thickness comprising:

a scoring head fixed to a first rotating shaft, the scoring head comprising, an annular body member comprising a rigid material that extends radially outward with respect to the first rotating shaft, and a raised annular section extending radially outward from the body member of the scoring head, the raised annular section comprising a rigid material; and an anvil fixed to a second rotating shaft, the anvil comprising, an annular base formed of a resiliently deformable material that extends radially outward with respect to the second rotating shaft and when uncompressed defines a shoulder that extends no further radially than a first distance from the second rotating shaft, and an annular section formed of a resiliently deformable material that is axially inset with respect to the shoulder of the anvil and when uncompressed extends radially outward from the second rotating shaft, the annular section defining a substantially axially facing side that is adjacent the shoulder and a substantially radially outward facing side that is a second radial distance from the second rotating shaft, the second distance being greater than the first distance.

19. A method for scoring corrugated paperboard of varying thickness, comprising the steps of:

passing paperboard of varying thickness adjacent a scoring head fixed to a first rotating shaft, the scoring head comprising an annular body member comprising a rigid material that extends radially outward with respect to the first rotating shaft, the scoring head further comprising a raised annular section extending radially outward from the body member of the scoring head, the raised annular section comprising a rigid material;

positioning on the opposite side of the corrugated paperboard from the scoring head an anvil fixed to a second rotating shaft, the anvil comprising an annular base formed of a resiliently deformable material that extends radially outward with respect to the second rotating shaft and when uncompressed defines a shoulder that extends no further radially than a first radial distance from the second rotating shaft, the anvil further comprising an annular section formed of a resiliently deformable material that is axially inset with respect to the shoulder of the anvil and when uncompressed extends radially outward from the second rotating shaft, the annular section defining a substantially axially facing side that is adjacent the shoulder and a substantially radially outward facing side that is a second radial distance from the second rotating shaft, the second distance being greater than the first distance; and applying pressure to bias the anvil and the scoring head toward each other.

20. An anvil for a scoring assembly for scoring corrugated paperboard of varying thickness comprising:

an annular base formed of a resiliently deformable material that extends radially outward with respect to the second rotating shaft and when uncompressed defines a shoulder that extends no further radially than a first radial distance from the second rotating shaft, and an annular section formed of a resiliently deformable material that is axially inset with respect to the shoulder of the anvil and when uncompressed extends radially outward from the second rotating shaft, the annular section defining a substantially axially facing side that is adjacent the shoulder and a substantially radially outward facing side that is a second radial distance from the second rotating shaft, the second distance being greater than the first distance.

21. A scoring assembly for scoring corrugated paperboard of varying thickness comprising:

a scoring head fixed to a first rotating shaft, the scoring head comprising, an annular body member comprising a rigid material that extends radially outward with respect to the first rotating shaft, and a raised annular section extending radially outward from the body member of the scoring head, the raised annular section comprising a rigid material; and an anvil fixed to a second rotating shaft, the anvil comprising, an annular base formed of a resiliently deformable material that extends radially outward with respect to the second rotating shaft and when uncompressed defines a shoulder that extends no further radially than a first distance from the second rotating shaft, an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance, and the substantially radially outward facing side of the annular section of the anvil opposing the raised annular section of the scoring head.

22. A method for scoring corrugated paperboard of varying thickness, comprising the steps of:

passing paperboard of varying thickness adjacent a scoring head fixed to a first rotating shaft, the scoring head comprising an annular body member comprising a rigid material that extends radially outward with respect to the first rotating shaft, the scoring head further comprising a raised annular section extending radially outward from the body member of the scoring head, the raised annular section comprising a rigid material;

positioning on the opposite side of the corrugated paperboard from the scoring head an anvil fixed to a second rotating shaft, the anvil comprising an annular base formed of a resiliently deformable material that extends radially outward with respect to the second rotating shaft and when uncompressed defines a shoulder that extends no further radially than a first distance from the second rotating shaft, the anvil further comprising an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance, the substantially radially outward facing side of the annular section of the anvil opposing the raised annular section of the scoring head; and applying pressure to bias the anvil and the scoring head toward each other.

23. An anvil for a scoring assembly for scoring corrugated paperboard of varying thickness comprising:

an annular base formed of a resiliently deformable material that extends radially outward with respect to the second rotating shaft and when uncompressed defines a shoulder that extends no further radially than a first distance from the second rotating shaft;

an annular section formed of a resiliently deformable material that is axially inset with respect to the shoulder of the anvil and when uncompressed extends radially outward from the second rotating shaft, the annular section defining a substantially radially outward facing side that is a second radial distance from the second rotating shaft, the second distance being greater than the first distance; and the substantially radially outward facing side of the annular section of the anvil opposing the raised annular section of the scoring head.

* * * * *

UNITED STATES PATENT AND TRADEMARK OFFICE

CERTIFICATE OF CORRECTION

PATENT NO. : 5,873,807

DATED : February 23, 1999

INVENTOR(S) : Lauderbaugh et al.

It is certified that error appears in the above-identified patent and that said Letters Patent is hereby corrected as shown below:

In column 5, line 58, please delete [the] and insert in place thereof --a--
In column 7, line 31, please delete [the] and insert in place thereof --a--
In column 8, line 45, please delete [the] and insert in place thereof --a--

Signed and Sealed this

Thirtieth Day of May, 2000

*Attest:*

Q. TODD DICKINSON

*Attesting Officer*

*Director of Patents and Trademarks*